United States Patent [19]

Böcker

[11] Patent Number: 4,655,323

[45] Date of Patent: Apr. 7, 1987

[54] LOCKING DEVICE FOR EXTENSIBLE ELEVATOR SECTIONS

[75] Inventor: Albert Böcker, Werne, Fed. Rep. of Germany

[73] Assignee: GmbH & Co. KG Albert Böcker, Fed. Rep. of Germany

[21] Appl. No.: 816,132

[22] Filed: Jan. 3, 1986

[30] Foreign Application Priority Data

Jan. 12, 1985 [DE] Fed. Rep. of Germany ..... 3500876

[51] Int. Cl.[4] ..... B66F 9/08; E04H 12/34

[52] U.S. Cl. ..... 187/1 R; 187/9 E; 182/210; 182/212; 52/121

[58] Field of Search ..... 187/9 E, 95, 1 R; 182/212, 210–211, 63; 52/111, 121, 123.1

[56] References Cited

U.S. PATENT DOCUMENTS

| | | | |
|---|---|---|---|
| 762,346 | 6/1904 | Piper | 182/212 |
| 2,339,120 | 1/1944 | Ulinski | 187/9 E X |
| 2,778,556 | 1/1957 | Johnson | 182/212 X |

FOREIGN PATENT DOCUMENTS

| | | | |
|---|---|---|---|
| 3001410 | 7/1982 | Fed. Rep. of Germany . | |
| 17594 | of 1905 | United Kingdom | 182/212 |

*Primary Examiner*—Joseph J. Rolla
*Assistant Examiner*—Nils E. Pedersen
*Attorney, Agent, or Firm*—George A. Evans

[57] ABSTRACT

An elevator, especially an oblique elevator, has a plurality of telescopic sections, along which a load container is movable. The telescoping of the sections takes place in such a manner that all the telescopic sections move simultaneously in relation to one another, or in such a manner that, as a given telescopic section extends, it takes with it all those arranged after it, as a "pack". For the purpose of locking in any desired position of extension a locking/unlocking device is provided between each pair of adjacent telescopic sections. This locking is effected by the actuation of a draw cable attached to the lowermost telescopic section, the draw cable acting upon an actuating cable which effects the locking or unlocking. The actuating cable runs in tackle block manner around two cable guides, and is shortened or lengthened by the variation of spacing of two cable guides.

10 Claims, 3 Drawing Figures

LOCKING DEVICE FOR EXTENSIBLE ELEVATOR SECTIONS

BACKGROUND OF THE INVENTION

This invention relates to an elevator constituted by a plurality of telescopic sections along which a load container can travel, and in particular to an elevator having a respective locking device between each two adjacent telescopic sections.

A known elevator of this type is constituted by a plurality of relatively-movable telescopic sections, all of which can be extended at the same time by actuation of a cable winch. In other words, relative movement takes place simultaneously between all telescopic sections—perhaps with the exception of the first (lowest) telescopic section.

With such an elevator, it is desirable that, when a desired length of extension is reached, all the telescopic sections can be locked together. In the known elevator, this locking takes place by actuating a draw cable associated with the lowermost telescopic section. Actuation of this draw cable effects both the locking between the lowermost telescopic section and the adjacent telescopic section, and the pivoting movement of a pivot body arranged on the lowermost telescopic section. The pivotal movement of this pivot body results in the shortening of a further draw cable which runs from the lower end of the said adjacent telescopic section to the upper end thereof. The shortening of this further draw cable effects both the locking between said adjacent telescopic section and the subsequent telescopic section, and the pivoting movement of a further pivot body. This, in turn, shortens a further draw cable, and so on until all pairs of adjacent telescopic sections are locked together (see DE-PS No. 3,001,410).

This known elevator has the advantage that actuation of a single draw cable results in the actuation of all the further draw cables, thereby resulting in all the telescopic sections being locked together, without the need for a long cable conducted over all the telescopic sections which would have the disadvantage of cable elasticity, and thus inexact response characteristics of the locking devices.

A disadvantage of this known type of elevator is that relatively high tensions are necessary in the individual draw cables, and thus corresponding high forces are needed for their actuation, if the locking system is to respond exactly. This results in a correspondingly high cost for maintanence and inspection. Moreover, the "shortenings" and "lengthenings" of the draw cables which result from the pivoting of the pivot bodies are very slight, so that a very exact adjustment of cable tension is needed. Another disadvantage is that the "lengthening" or "shortening" introduced into the actuating draw cable corresponds substantially to that which is introduced into the (substantially longer) draw cables which run over the pivot bodies of the remaining telescopic sections. It is obvious that the cable elasticity inherent in the longer draw cables neutralises part of this "lengthening" or "shortening" of the actuating draw cable.

The object of the invention is to provide an elevator which has a locking system with an increased accuracy of response and increased reliability with a reduced expenditure of force. Another object is to prevent neutralisation of the cable lengthening and shortening by cable stretch.

SUMMARY OF THE INVENTION

The present invention provides an elevator having a plurality of telescopic sections, a respective cable-actuated locking/unlocking device being provided between each pair of adjacent telescopic sections, wherein each locking/unlocking device includes an actuating cable and two cable guides, the actuating cable passing at least partially around said cable guides, the length of the actuating cable being adjustable by variation of the distance between said cable guides, the variation of the distance between the cable guides of each locking/unlocking device being effected by a respective draw cable which displaces one cable guide in relation to the other cable guide, and wherein the draw cable which effects the variation of the distance between the cable guides of the locking/unlocking device provided between the first (lowermost) and second telescopic sections runs from the lower end of the first telescopic section to the upper end thereof, the draw cable which effects the variation of the distance between the cable guides of each succeeding locking/unlocking device running from the lower end of the upper telescopic section of the associated pair of telescopic sections to the upper thereof, while, with the exception of the draw cable allocated to the first telescopic section, each draw cable is guided over a further pair of variably-spaced cable guides provided on the lower telescopic section of the associated pair of telescopic sections.

Thus, the draw cable does not—as was the case with the known prior art—effect the pivoting of a pivotable body, and thus the shortening of the next succeeding draw cable and of the actuating cable for the locking, but the draw cable alters the spacing of two cable guides—which are looped around in tackle block manner by the next succeeding draw cable and/or the actuating cable. The looping around in tackle block manner achieves, with reduced expenditure of force, an increase of the cable shortening. This increased cable shortening permits a more defined pivoting movement of the locking dogs of the locking/unlocking devices. Since both the cable guides for the actuating cable and the cable guides for the draw cables are variable in spacing, and both cable guides are coupled with one another, the variation of spacing of each draw cable is transmitted exactly to the respective actuating cable and a satisfactory locking or unlocking is effected.

Advantageously, the pair of cable guides associated with each actuating cable are arranged on a beam provided on the lower telescopic section of the associated pair of telescopic sections, the cable guides of the draw cable (when present) for the adjacent locking/unlocking device being arranged on the same beam. Preferably, each beam is pivotably mounted on the associated telescopic section.

In a preferred embodiment, in the region of the upper end of each telescopic section (with the exception of the uppermost telescopic section), there is non-displaceably mounted a cable guide for the associated actuating cable, and, in the region of the upper end of each telescopic section (with the exception of the two uppermost telescopic sections), there is non-displaceably mounted a cable guide for the associated draw cable, each of said cable guides having associated therewith a further cable guide variable in spacing therefrom. This results in an advantageous allocation of the individual draw cables and actuating cables to the individual telescopic sections. This arrangement of the cable guides can also be provided, in an appropriate development of the invention, at the lower ends of the telescopic sections, in which case it would serve for the locking and unlocking of pivotable dog carriers, locking pawls or the like.

Advantageously, the variation of spacing of the movable cable guide associated with a given draw cable is greater than the spacing variation of the movable cable guide associated with actuating cable arranged on the same telescopic section. This arrangement of the cable guides for the actuating cables and the draw cables is such that the movable cable guide of a given draw cable experiences a greater variation of spacing than does the movable cable guide of the respective actuating cable. This is especially advantageous because the draw cable is substantially longer than the actuating cable, so that, with equal traction stressing, the greater cable elongation can be neutralised.

Conveniently, the cable guides of variable spacing are non-displaceably mounted on said associated beam, said beam being pivotably mounted, at one end, to the associated telescopic section in such a way that the movable cable guide for the respective draw cable is further from said one end of the beam than the movable pulley guide for the respective actuating cable. Preferably, each draw cable is attached to a stop provided on the associated beam between the movable cable guide for the draw cable of the adjacent telescopic section and the movable cable guide for the associated actuating cable. As a result, a "mechanical advantage" takes place to a certain extent between the cable length variation of each actuating cable and that of the associated draw cable.

Advantageously, a return spring may be arranged between each beam and the associated telescopic section. In this way, the locking/unlocking device can be returned to its original position, so that the draw cables are moved in the opposite direction to the actual actuating direction.

Preferably, each draw cable, with the exception of the draw cable for the first locking/unlocking device, is fixed to the lower end of the associated telescopic section by means of a tensioning device. This permits the tension of the individual draw cables—which must be constantly increased beginning from the lowermost telescopic section to the following telescopic sections—to be adjusted exactly.

Advantageously, each locking/unlocking device is a self-locking device which is loaded by a spring, the associated actuating cable serving for unlocking. Alternatively, each locking/unlocking device can be so formed that it is constantly situated under spring loading in the unlocked condition, and, on actuation of the associated draw cable, the spring force is overcome and locking is produced.

BRIEF DESCRIPTION OF THE DRAWINGS

One form of elevator constructed in accordance with the invention will now be described, by way of example, with reference to the accompanying drawings, in which.

DESCRIPTION OF PREFERRED EMBODIMENT

Figure 1:
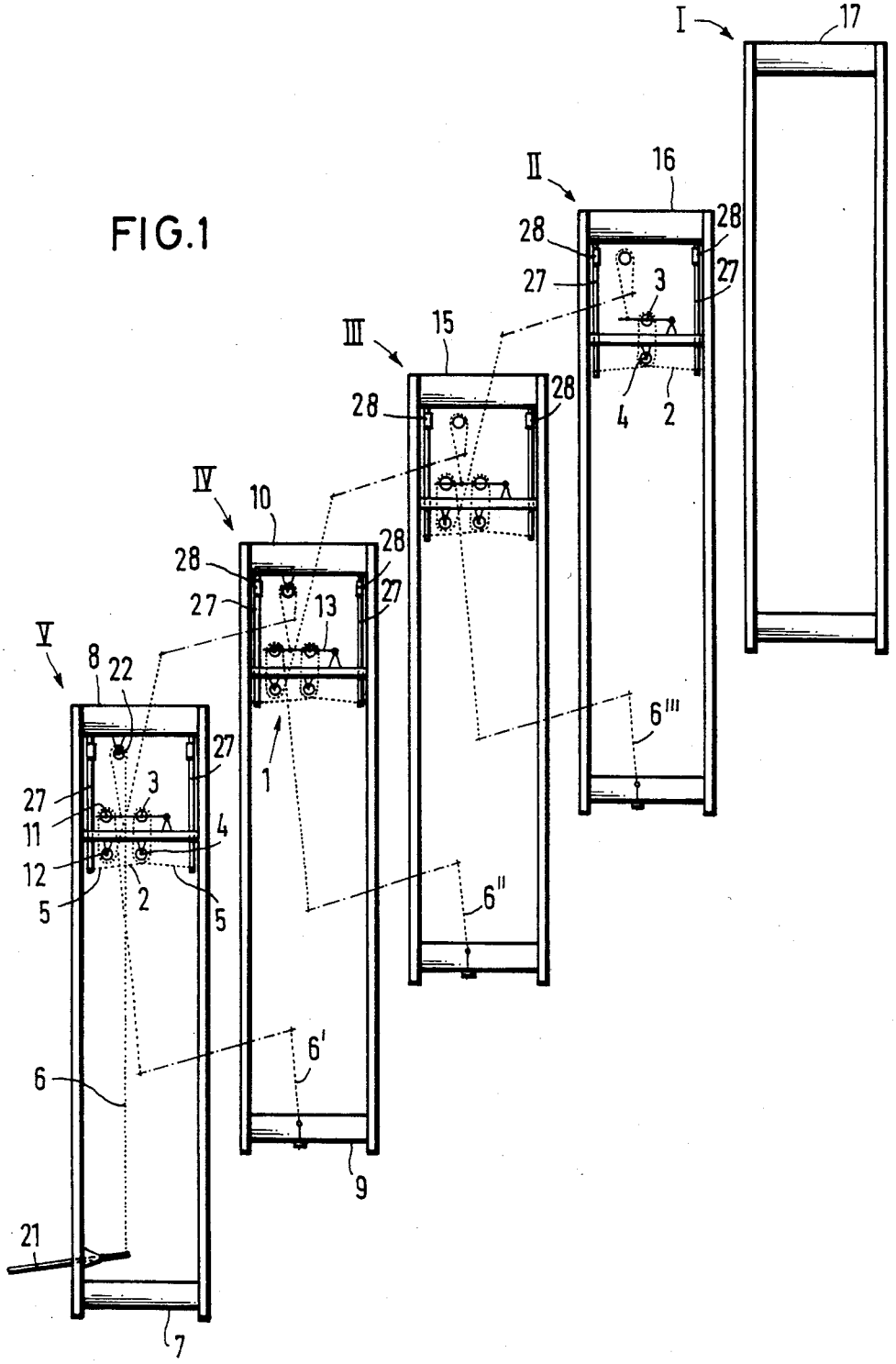
FIG. 1 is diagrammatic representation of the five telescopic sections of the elevator, the sections being shown side-by-side in plan view.

Referring to the drawings, FIG. 1 shows an elevator constituted by five telescopic sections I to V. A respective locking device 1 is provided between each pair of adjacent telescopic sections. Each locking device 1 includes a latch 28/29 for locking/unlocking the two associated telescopic sections together, an actuating cable 2, and a pair of pulleys 3 and 4. The locking devices 1 for the telescopic sections V and IV, IV and III and III and II each have a further pair of pulleys 11 and 12 for tensioning a draw cable 6', 6'', 6''' for the adjacent locking device. The locking device 1 for the telescopic sections I and II possesses only the pulleys 3 and 4 for actuating the actuating cable 2. Each telescopic section I to V is of ladder configuration, being constituted by a pair of rails and a plurality of rungs 14.

Figure 3:
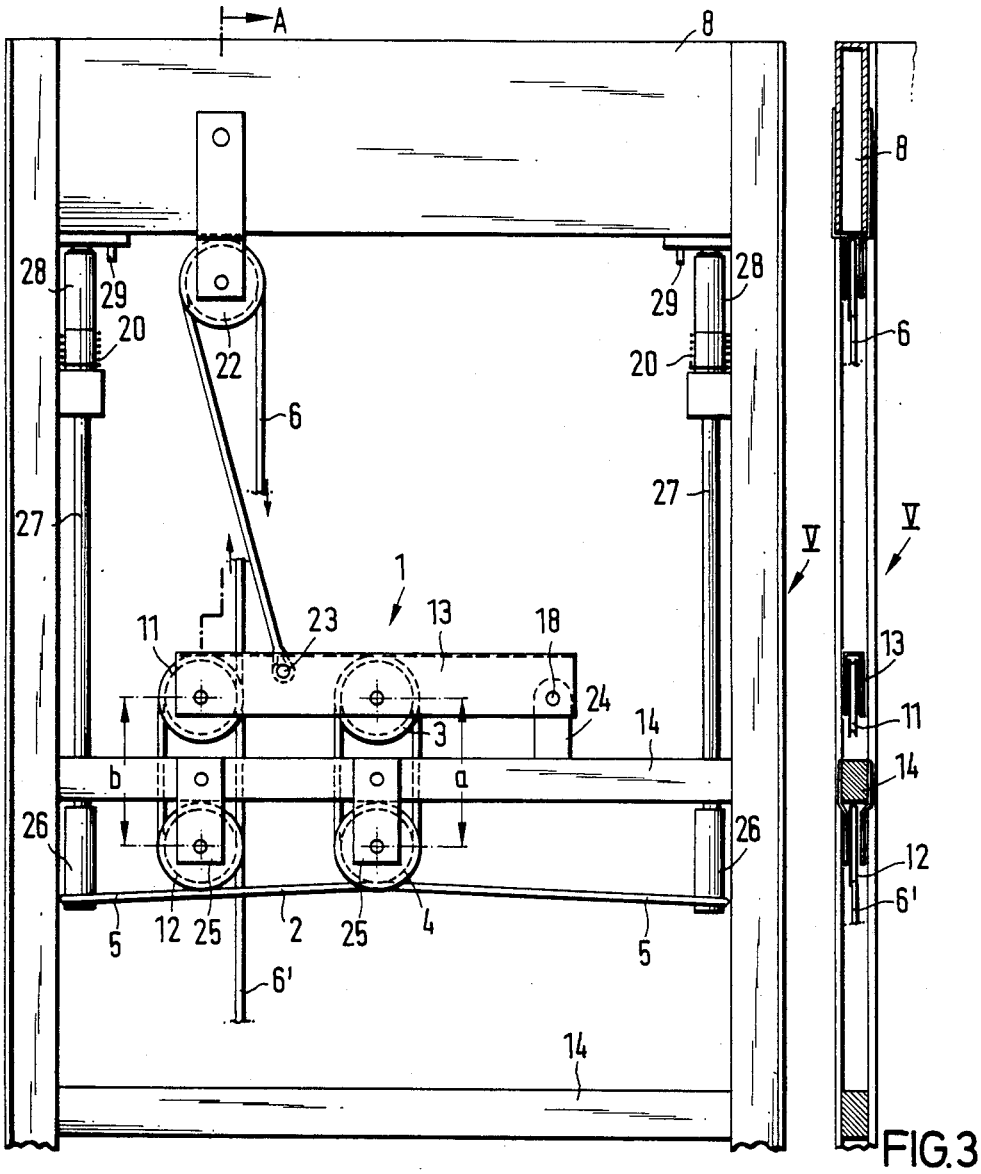
FIG. 3 is a cross-section taken on the line A–B of FIG. 2.
Figure 2:
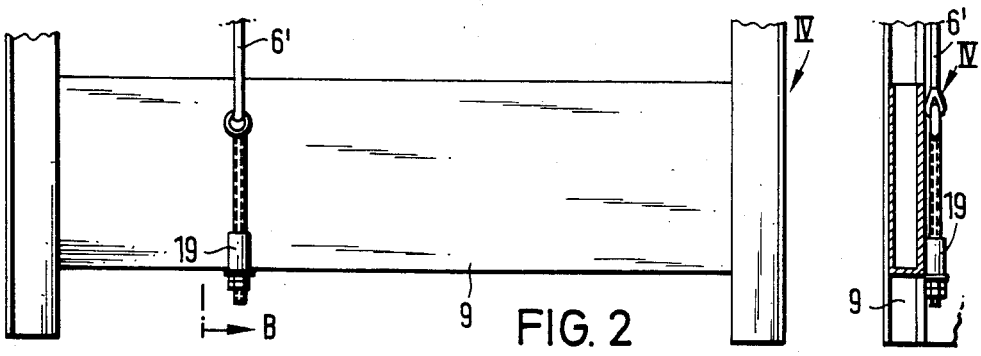
FIG. 2 is a front elevation of the upper end of the lowermost telescopic section and the lower end of the adjacent telescopic section.

The top portions of FIGS. 2 and 3 show the upper end of the telescopic section V, portions of these figures also showing the lower end 9 of the adjacent telescopic section IV. A draw cable 6, which comes from the lower end 7 and is operable by means of a hand lever 21, is guided in the region of the upper end 8 of this telescopic section IV over a reversing pulley 22, and is made fast to a stop 23 provided on a beam 13. The beam 13 is rotatably mounted at a pivot point 18; and is made fast, by means of a bracket 24, to a rung 14 of the telescopic section V.

Two further brackets 25 are provided on the rung 14, the further brackets serving for the mounting of the pulleys 4 and 12. Similarly, the pulleys 3 and 11 are mounted on the beam 13. The pulley 4 is preferably formed as double pulley, as this results in improved cable guidance.

The actuating cable 2 loops around the pulleys 3 and 4, the free ends 5 of the actuating cable being looped around the stub shafts 26 of locking shafts 27.

The draw cable 6' for the next locking device 1 loops around the pulleys 11 and 12, and is conducted from the lower end 9 of the telescopic section IV to the upper end 10 thereof (see FIG. 1).

It can be seen that, on actuation of the hand lever 21, a pull is exerted upon the draw cable 6, causing the beam 13 to pivot about the pivot point 18. The pulleys 3 and 11 will then move away from the pulleys 4 and 12, so that the distances a and b increase. This results in a shortening of the actuating cable 2, so that the locking shafts 27 are rotated in the unlocking direction. As this happens, locking dogs 28 associated with the shafts 27 come into the unlocking position and into abutment with pegs 9. At the same time, the draw cable 6 shortens, so that a corresponding pull is exerted upon the beam 13 of the adjacent telescopic section IV. This, in turn, activates the next locking device 1 and the next draw cable 6'', and this procedure carries on until all the locking devices actuated. Since the pulley 11 is more remote from the pivot point 18 than the pulley 3, a greater shortening of the draw cable 6' occurs, whereby account is taken of the greater length of the draw cable 6' (compared with the actuating cable 2) and thus the greater cable elasticity.

The tension of each of the draw cables 6', 6'' and 6''' is adjustable by means of a respective tensioning device 19.

Each locking shaft 27 (see FIG. 2) is associated with a spring 20, by means of which the associated locking dog 28 is brought into the locking position. In the embodiment shown in FIG. 2, therefore the actuating cable 2 serves exclusively for unlocking.

Alternatively, by arranging the actuating cable to loop around the stub shafts 26 in the opposite direction, the locking shafts 27 can be rotated in the opposite direction. In this case, the springs 20 bias the locking dogs 28 into the unlocking position, and the actuating cable 2 serves exclusively for locking.

As shown in FIG. 1, the locking devices are provided on each of the upper ends 8, 10, 15 and 16 of the telescopic sections V, IV, III and II, the upper end 17 of the telescopic section I remaining free from such locking. The telescopic section I can be made separately extensible, and capable of being angled off.

I claim:

1. An elevator having a plurality of telescopic sections, a respective cable-actuated locking/unlocking device being provided between each pair of adjacent telescopic sections, wherein each locking/unlocking device includes an actuating cable and two cable guides, the actuating cable passing at least partially around said cable guides, the length of the actuating cable being adjustable by variation of the distance between said cable guides, the variation of the distance between the cable guides of each locking/unlocking device being effected by a respective draw cable which displaces one cable guide in relation to the other cable guide, and wherein the draw cable which effects the variation of the distance between the cable guides of the locking-/unlocking device provided between the first (lowermost) and second telescopic sections runs from the lower end of the first telescopic section to the upper end thereof, the draw cable which effects the variation of the distance between the cable guides of each succeeding locking/unlocking device running from the lower end of the upper telescopic section of the associated pair of telescopic sections to the upper thereof, while, with the exception of the draw cable allocated to the first telescopic section, each draw cable is guided over a further pair of variably-spaced cable guides provided on the lower telescopic section of the associated pair of telescopic sections.

2. An elevator according to claim 1, wherein the pair of cable guides associated with each actuating cable are arranged on a beam provided on the lower telescopic section of the associated pair of telescopic sections, the cable guides of the draw cable (when present) for the adjacent locking/unlocking device being arranged on the same beam.

3. An elevator according to claim 2, wherein each beam is pivotably mounted on the associated telescopic section.

4. An elevator according to claim 3, wherein, in the region of the upper end of each telescopic section (with the exception of the uppermost telescopic section), there is non-displaceably mounted a cable guide for the associated actuating cable, and, in the region of the upper end of each telescopic section (with the exception of the two uppermost telescopic sections), there is non-displaceably mounted a cable guide for the associated draw cable, each of said cable guides having associated therewith a further cable guide variable in spacing therefrom.

5. An elevator according to claim 4, wherein the variation of spacing of the movable cable guide associated with a given draw cable is greater than the spacing variation of the movable cable guide associated with actuating cable arranged on the same telescopic section.

6. An elevator according to claim 4, wherein the cable guides of variable spacing are non-displaceably mounted on said associated beam, said beam being pivotably mounted, at one end, to the associated telescopic section in such a way that the movable cable guide for the respective draw cable is further from said one end of the beam than the movable pulley guide for the respective actuating cable.

7. An elevator according to claim 2, wherein each draw cable is attached to a stop provided on the associated beam between the movable cable guide for the draw cable of the adjacent telescopic section and the movable cable guide for the associated actuating cable.

8. An elevator according to claim 2, wherein each draw cable, with the exception of the draw cable for the first locking/unlocking device, is fixed to the lower end of the associated telescopic section by means of a tensioning device.

9. An elevator according to claim 1, wherein each locking/unlocking device is a self-locking device which is loaded by a spring, the associated actuating cable serving for unlocking.

10. An elevator according to claim 1, wherein each of the cable guides is a pulley.

* * * * *